United States Patent [19]

Borjesson et al.

[11] 4,128,125

[45] Dec. 5, 1978

[54] SPIRAL HEAT EXCHANGER

[75] Inventors: Leif R. Borjesson, Vellinge; Lars-Ake Johansson, Lund, both of Sweden

[73] Assignee: Alfa-Laval AB, Tumba, Sweden

[21] Appl. No.: 718,032

[22] Filed: Aug. 26, 1976

[30] Foreign Application Priority Data

Aug. 28, 1975 [SE] Sweden ..... 7509552

[51] Int. Cl.[2] ..... F28F 3/08

[52] U.S. Cl. ..... 165/163

[58] Field of Search ..... 165/167, 166

[56] References Cited

U.S. PATENT DOCUMENTS

| | | | |
|---|---|---|---|
| 1,930,879 | 10/1933 | Lindroth et al. | 165/163 |
| 2,639,531 | 5/1953 | Newhall | 165/167 |
| 2,677,531 | 5/1954 | Hock, Sr. et al. | 165/167 |
| 3,196,937 | 7/1965 | Jenssen | 165/166 |
| 3,448,796 | 6/1969 | Usher | 165/167 |
| 3,605,881 | 9/1971 | Doi | 165/167 |

*Primary Examiner*—Charles J. Myhre
*Assistant Examiner*—Theophil W. Streule, Jr.
*Attorney, Agent, or Firm*—Cyrus S. Hapgood

[57] ABSTRACT

A spiral heat exchanger comprises a generally cylindrical spiral body having two parallel, spirally-shaped flow passages for heat exchanging media. An end wall is releasably connected to the spiral body at each end thereof, the spiral body and at least one end wall being movable along a track and independently rotatable around a vertical axis.

6 Claims, 9 Drawing Figures

SPIRAL HEAT EXCHANGER

The present invention relates to a spiral heat exchanger of the kind comprising a generally cylindrical spiral body provided with at least two parallel, spiral-shaped flow passages for heat exchanging media, and an end wall provided at each end of the spiral body and releasably connected thereto.

In conventional heat exchangers of this kind, the spiral body is usually supported by a frame welded thereto. The spiral body is further provided with hinges by which the end walls are rotatably supported thereon.

The end walls comprise generally circular plates which must be specially manufactured for each spiral body in order to match therewith. The end walls are clamped to the spiral body by means of a large number of circumferentially spaced hook bolts, and for this purpose they must be provided with edge rings welded thereto and having a special cross-section. To resist the usual pressure load, the end walls are provided with conical reinforcements welded thereto, and to obtain proper sealing against the spiral body in spite of the pressure load, the sealing surfaces of the end walls are turned slightly conical.

The respective heat exchanging media are fed to and from the heat exchanger via a central tube connection in each end wall, and two corresponding peripheral connections on the spiral body.

A spiral heat exchanger constructed in this way is disadvantageous from several points of view. Primarily, a considerable effort of manual labor is required for its manufacture, which is expensive. Since the end walls are specially made for each individual spiral body, it is difficult or impossible to manufacture the heat exchangers efficiently and to maintain an adequate supply of spare parts. Further, a free space is required on each side of the heat exchanger in order to allow opening of the end walls for inspection and cleaning of the spiral body. The tube conduits coupled to the tube connections of the end walls must then be removed.

In accordance with the present invention, a spiral heat exchanger is provided which allows efficient production and keeping of spare parts in that the parts included therein can be standardized. The space requirement has been reduced and the maintenance has been facilitated because the apparatus can be disassembled and cleaned without the need of loosening the connected tube conduits. Further, the new design makes it possible to mount several spiral bodies in one and the same frame.

The spiral heat exchanger according to the invention is generally characterized in that the spiral body and at least one end wall are movable along a track and independently rotatable around a vertical axis.

Further advantages of the invention will become apparent from the following description, made with reference to the accompanying drawings.

Figure 2:
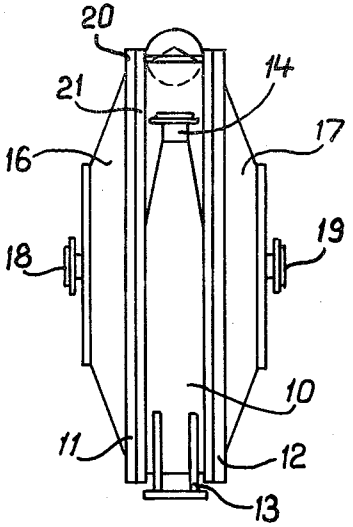
FIGS. 1 and 2 are front and side elevational views, respectively, of a conventional spiral heat exchanger.
Figure 1:
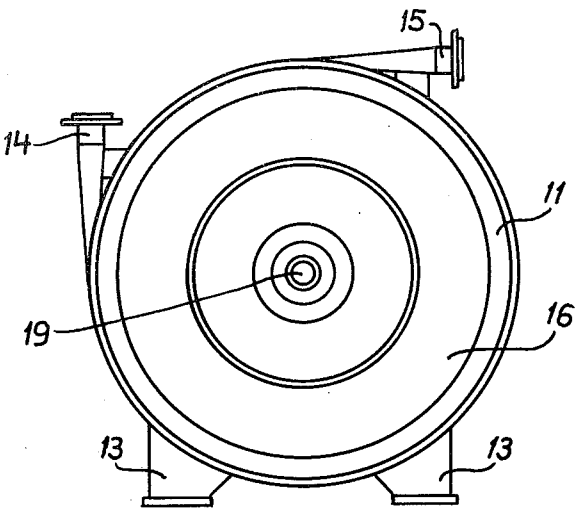

The conventional spiral heat exchanger shown in FIGS. 1 and 2 comprises a central spiral body 10, and two end walls 11, 12. The spiral body 10 is supported by supporting legs 13 and is provided with two tangential tube connections 14, 15. The end walls are provided with pressure-resisting, conical reinforcements 16, 17 and have central tube connections 18 and 19, respectively. The end walls as well as the spiral body are provided with edge rings 20 and 21 of a special cross-section adapted to cooperate with a series of hook bolts (not shown) for releasably clamping the end walls to the spiral body.

Figure 3:
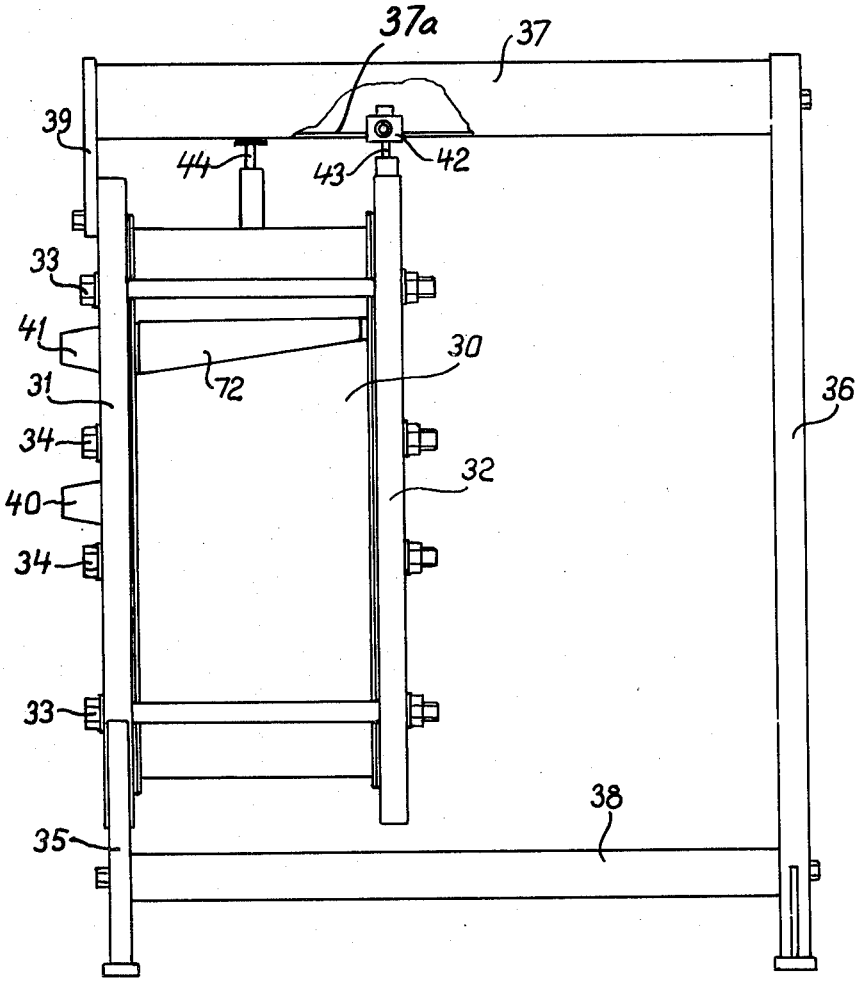
FIGS. 3 and 4 are side and front elevational views, respectively, of a first embodiment of the spiral heat exchanger according to the invention.
Figure 4:
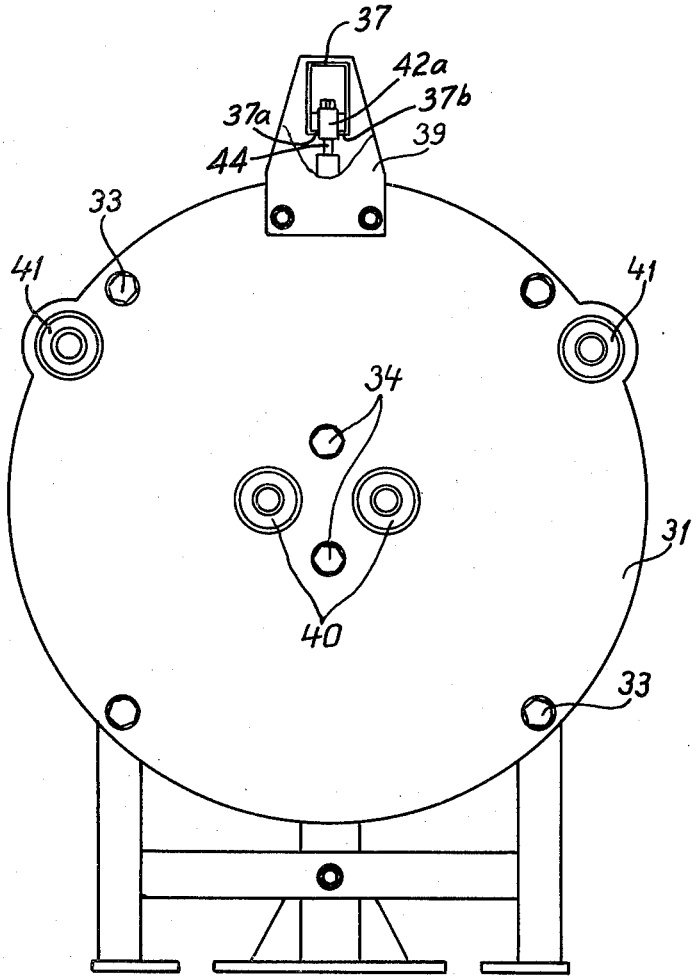

The spiral heat exchanger according to the invention, as shown in FIGS. 3 and 4, has a spiral body 30 provided with two end walls 31 and 32 which are held together by means of four peripherically disposed clamp bolts 33 and two centrally disposed clamp bolts 34. The heat exchanger is supported by a frame comprising supporting legs 35 fixed to the left hand end wall 31, a vertical strut 36, and upper and lower horizontal beams 37 and 38, respectively. The upper beam at one end is connected to the left hand end wall 31 via a bracket 39, and its other end is connected to the vertical strut 36. The last-mentioned end wall 31 thus constitutes a stationary part of the supporting framework, and all tube connections are provided in this end wall, namely, two central tube connections 40 and two peripherical tube connections 41.

The upper beam 37 comprises a channel which opens downwards and has inwardly bent, lower flanges **37*a* and 37*b* forming a track along which the right hand end wall 32 is slidably suspended by means of a trolley 42. The end wall 32 is suspended on the trolley by means of a vertical shaft 43 which is rotatably journalled in the trolley. In the same way, the spiral body 30 is suspended for rotation and for sliding movements along the beam 37 by a trolley 42*a* from which spiral body 30 is suspended by means of a vertical shaft 44 rotatably journalled in the trolley 42*a* (FIG. 4). Thus, after removal of the bolts 33 and 34, the end wall 32 and the spiral body 30 can each be moved in the direction of the beam 37 and rotated around its respective vertical axis, so that they are easily available for cleaning and inspection. Since all the tube connections 40, 41 are mounted on the stationary end wall 31**, the tube conduits (if any) connected thereto need not be disconnected.

Figure 5:
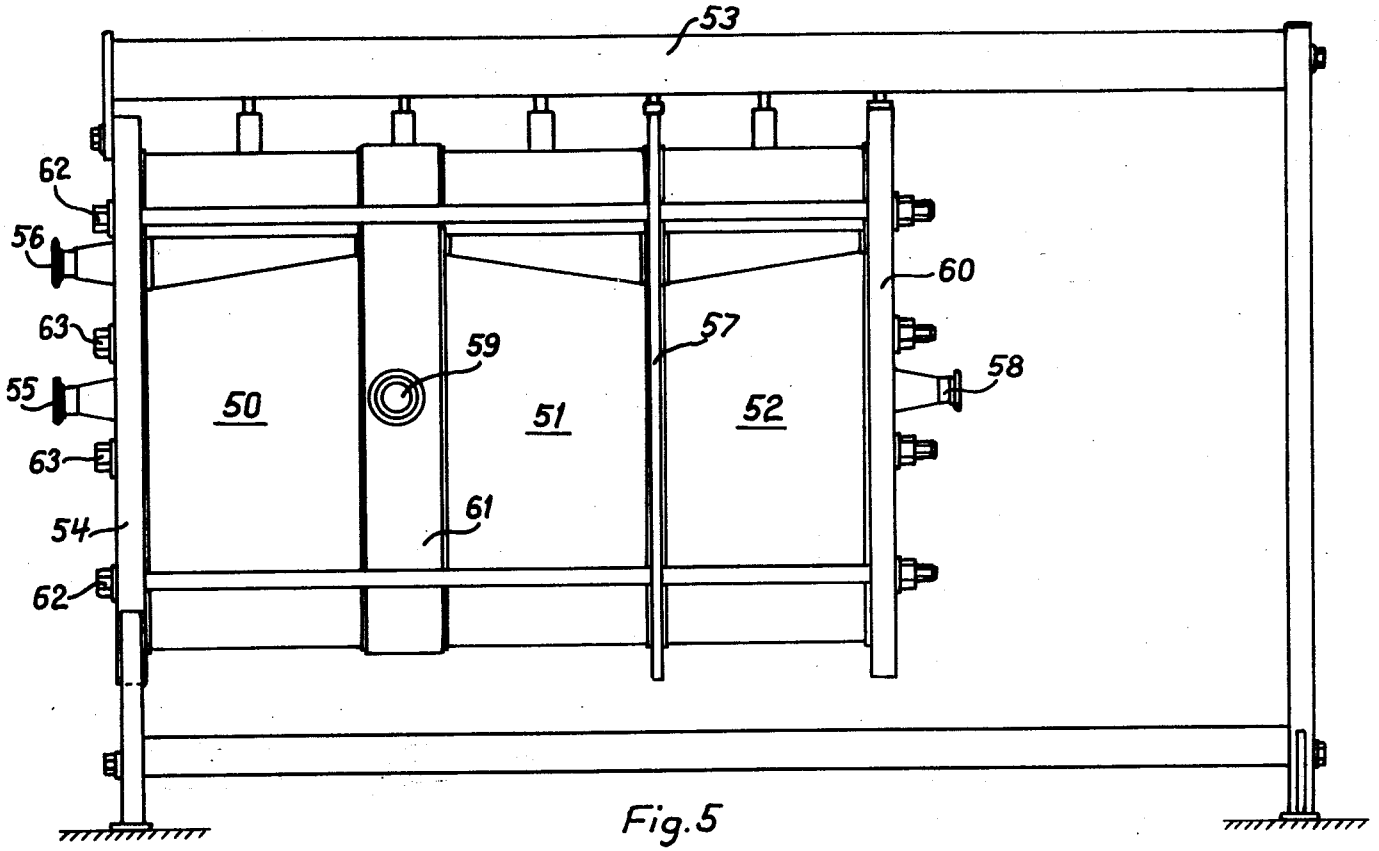
FIG. 5 is a side elevational view of a second embodiment of the spiral heat exchanger.

In order to illustrate the flexibility of the design according to the invention, FIG. 5 shows a combination of three spiral bodies 50, 51 and 52 mounted in a single common frame. The frame is constructed in the same way as that shown in FIG. 3 but has larger dimensions than the latter and thus comprises an upper, supporting beam 53 forming a track, and a stationary heat exchanger end wall 54.

The left hand spiral body 50 in FIG. 5 operates as an independent unit, the heat exchanging media being supplied and discharged through tube connections 55, 56 provided on the stationary end wall 54, in the same way as has been described with reference to FIGS. 3 and 4. The two right hand spiral bodies 51 and 52, on the other hand, which are separated by a partition plate 57, are connected in series to form a common heat exchanger unit which is supplied with heat exchanging media via tube connections 58 and 59 provided on the right hand end wall 60 and a connection plate 61, respectively. The partition plate 57 is provided with through-flow openings (not shown) required to allow communication between the spiral bodies 51, 52.

All three spiral bodies 50-52, as well as the partition plate 57, the connection plate 61 and the end wall 60, are slidably and rotatably suspended on the overhead beam 53 and are clamped together by means of bolts 62, 63 extending between the two end walls 54 and 60. After removal of these bolts, all the elements suspended from the beam 53 may thus be displaced independently therealong and turned around for inspection, cleaning or the like.

Figure 6:
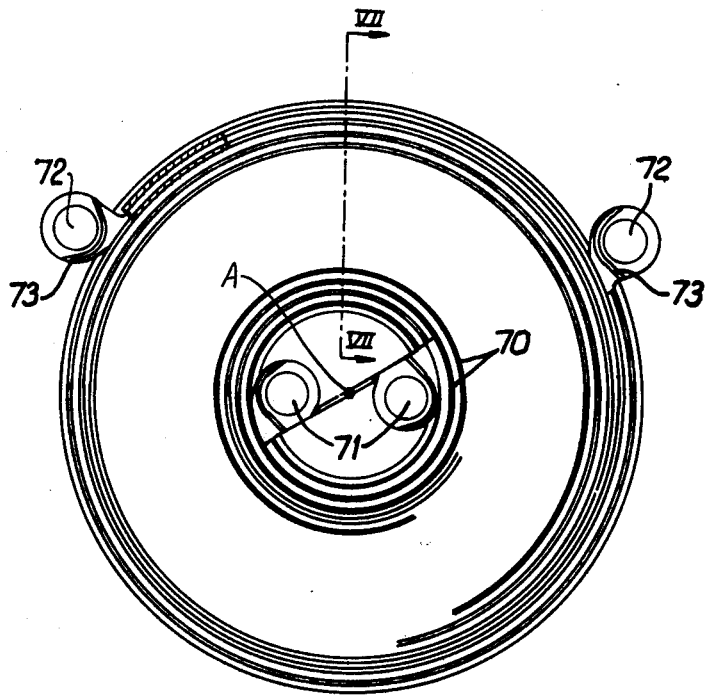
FIGS. 6 and 7 are front elevational and longitudinal sectional views, respectively, of the spiral body included in the heat exchanger.
Figure 7:
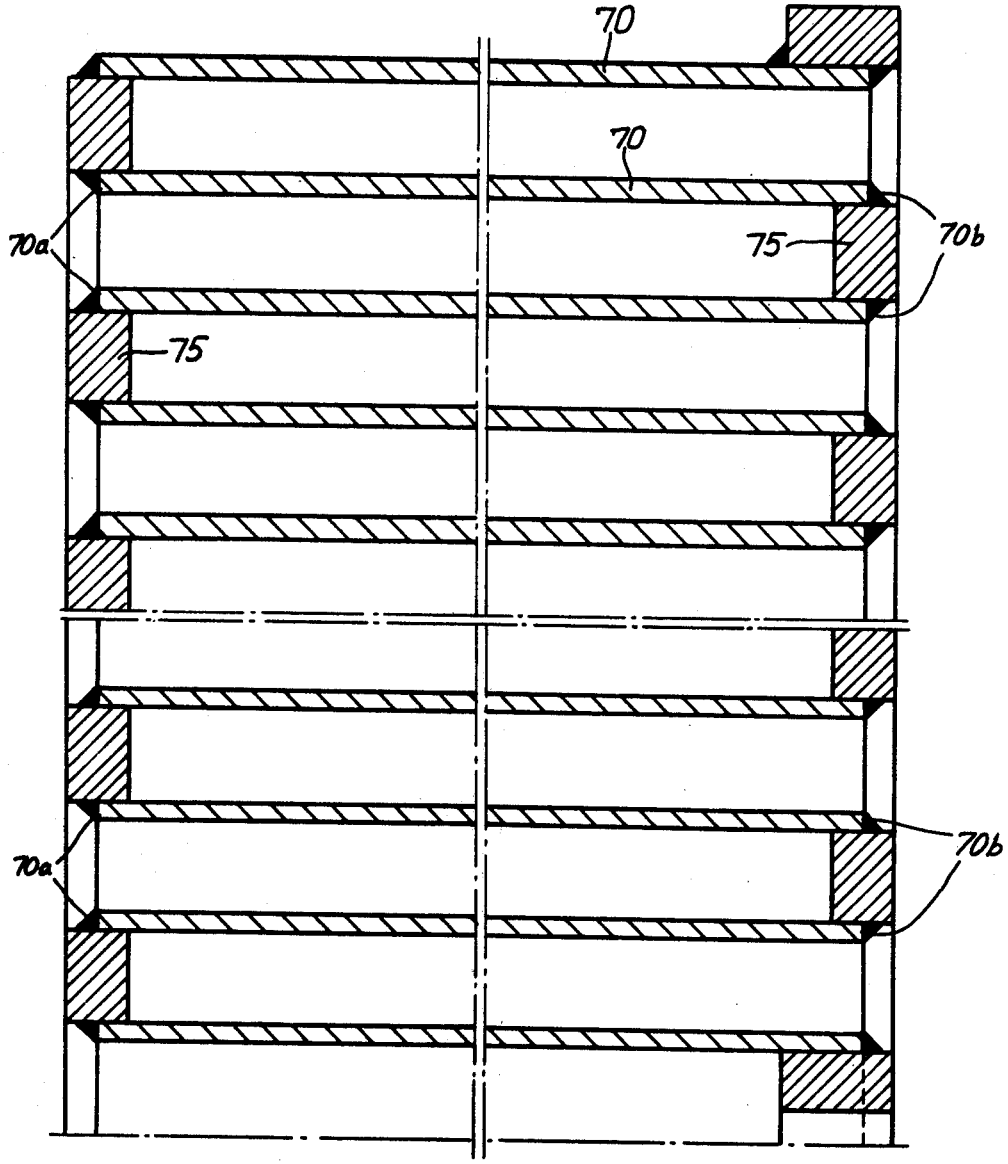
Figure 8:
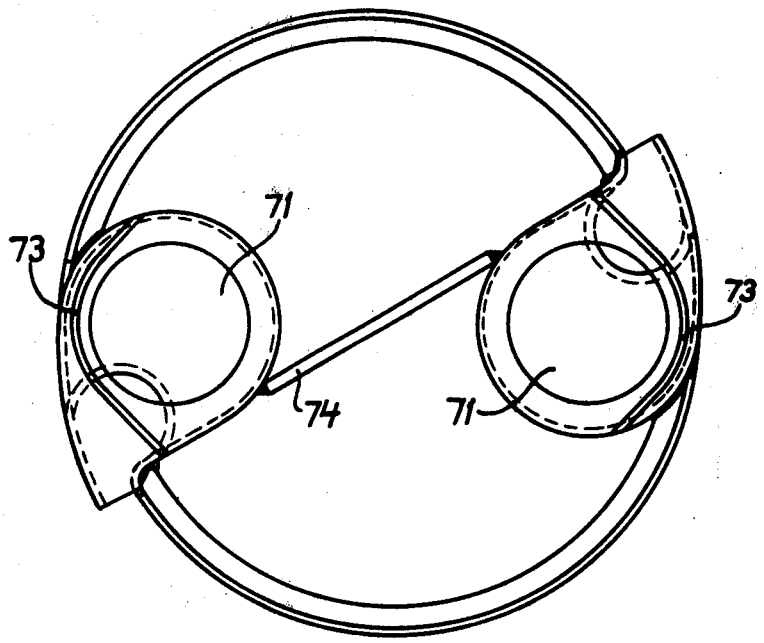
FIG. 8 is an enlarged end view of the center portion of the spiral body.

In FIGS. 6–8, a spiral body is shown in more detail. As appears from these views, the spiral body is constructed of two metal sheets 70 forming between them flow passages for heat exchanging media and being spirally wound around a common axis shown at A in FIG. 6 and passing through a center which is shown enlarged in FIG. 8. Two manifolds 71 are provided in this center, and two corresponding manifolds 72 are mounted at the periphery of the spiral body. These manifolds are oriented to match the corresponding tube connections in the stationary end wall; and to provide satisfactory axial distribution of the flow, they are made conical (FIGS. 3 and 5). The sealing surfaces of the manifolds are provided with drain grooves 73 whereby any leakage is removed. The entrance of a leaking medium into the wrong passage of the heat exchanger is thereby prevented, and mixing of different heat exchanging media is thus avoided.

In the center portion of the spiral body shown in FIG. 8, the two manifolds 71 are interconnected by a bracing plate 74 welded thereto. In addition to containing these manifolds, the center portion also forms open ducts extending axially through the spiral body and allowing the bolts 34 to be passed therethrough. The central position of these bolts is advantageous with regard to loading and thus results in less deflexion of the end walls.

As appears from FIG. 7, spacing bars 75 are welded between the spirally wound metal sheets 70 at both ends of the spiral body (i.e., adjacent the opposite side edges **70*a* and 70*b*** of these sheets). Each of the two flow passages formed between the sheets is thereby closed at one end of the spiral body, as appears from the figure. For inspection and cleaning of these passages, it is therefore required that the spiral body be accessible from both ends, which is considerably facilitated by the fact that it is suspended for rotation around its vertical axis, as described above.

Figure 9:
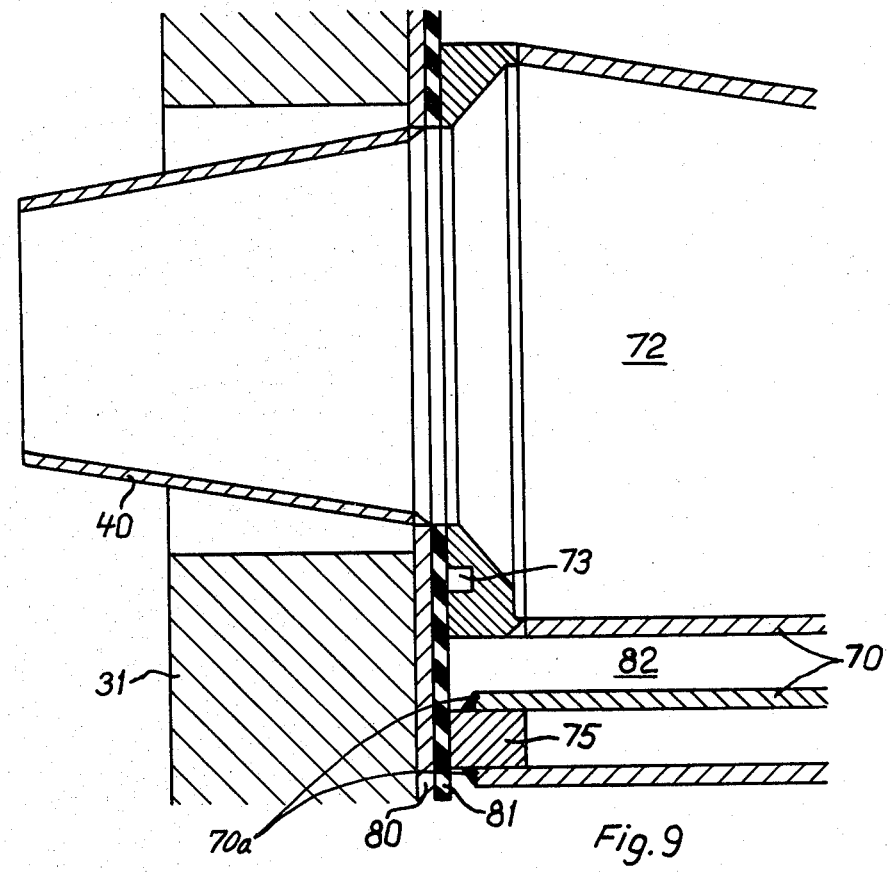
FIG. 9 shows an element of the heat exchanger according to FIGS. 3–5 in longitudinal section and on an enlarged scale.

The sectional view in FIG. 9 illustrates the interconnection of the spiral body 30 and the stationary end wall 31 of the spiral heat exchanger according to FIG. 3, but the construction is also applicable to corresponding parts of the heat exchanger shown in FIG. 5.

As shown in FIG. 9, a lining sheet 80 is provided inside the end wall 31. The tube connection 40 is welded to this sheet, as are also the rest of the tube connections (not shown in FIG. 9). A rubber sheet 81 is disposed between the lining sheet 80 and the spiral body, this rubber sheet functioning as a sealing element. The function of the drain groove 73 (also shown in FIGS. 6 and 8) also appears from FIG. 9. From the latter, it is apparent that in case of a possible leakage between the manifold 72 and the adjacent flow passage, which is here designated 82, the leaking medium will be drained via the groove 73, whereby mixing of different media is prevented. A possible leakage bypassing the spacing bar 75 cannot cause such mixing of different media, since in such case the leaking would only take place between different portions of the same flow passage.

As shown in FIG. 9, end wall 31 is located adjacent the side edges **70*a* of the spiral sheets 70; and it will be understood that the other end wall 32 in FIG. 3 is located adjacent the opposite side edges 70*b* (FIG. 7**) of the spiral sheets.

It will be understood that further modifications of the new heat exchanger are possible, in addition to the embodiments described above, within the scope of the inventive idea.

We claim:

1. A spiral heat exchanger comprising at least one generally cylindrical spiral body forming parallel, spirally-shaped flow passages for heat exchanging media, said body including at least two sheets spirally wound around a common axis to define said flow passages between the sheets, each said sheet having opposite side edges, an end wall releasably connected to the spiral body at each end thereof, the end walls having inlet and outlet means communicating with said flow passages and being located adjacent said opposite side edges, respectively, of the sheets, a track, and means mounting the spiral body and one end wall on the track for movement therealong, said mounting means including elements supportined said spiral body and said one end wall for rotation independently of each other about respective vertical axes.

2. The heat exchanger of claim 1, in which there are a plurality of generally cylindrical spiral bodies adjacent each other and which includes also a plate between each pair of adjacent spiral bodies for providing communication to at least one spiral flow passage therein, each spiral body and each said plate being supported by said mounting means for movement along the track and for rotation independently about a vertical axis.

3. The heat exchanger of claim 1, comprising also a frame including an overhead beam which forms said track, said mounting means including trolleys movable along the track and from which said spiral body and one of said end walls, respectively, are suspended.

4. The heat exchanger of claim 3, in which the other of said end walls is stationary and forms part of said frame.

5. The heat exchanger of claim 4, in which said stationary end wall is provided with connections for inlet and outlet conduits.

6. The heat exchanger of claim 5, in which all the connections for the inlet and outlet conduits of the heat exchanger are provided in said stationary end wall.

* * * * *